US005936137A

United States Patent [19]

Zachariah et al.

[11] Patent Number: 5,936,137

[45] Date of Patent: Aug. 10, 1999

[54] PROCESS FOR DESTROYING HALOGENATED COMPOUNDS

[75] Inventors: Michael R. Zachariah, Gaithersburg, Md.; Douglas P. DuFaux, Charlotte, N.C.

[73] Assignee: The United States of America as represented by the Secretary of Commerce, Washington, D.C.

[21] Appl. No.: 08/870,714

[22] Filed: Jun. 6, 1997

[51] Int. Cl.[6] ..... A62D 3/00; C10G 17/00

[52] U.S. Cl. ..... 588/206; 208/262.1

[58] Field of Search ..... 588/206; 423/449.1, 423/449.2, 445 R, 499.1, 499.4; 208/262.1, 262.2

[56] References Cited

U.S. PATENT DOCUMENTS

| | | | |
|---|---|---|---|
| 4,029,484 | 6/1977 | Fitzpatrick | 55/71 |
| 4,377,471 | 3/1983 | Brown et al. | 208/262 |
| 4,465,590 | 8/1984 | Adams | 208/262 |
| 5,108,647 | 4/1992 | Bölsing | 585/400 |
| 5,376,346 | 12/1994 | Powers | 588/248 |
| 5,556,779 | 9/1996 | Khindaria et al. | 588/206 |

FOREIGN PATENT DOCUMENTS

| | | |
|---|---|---|
| 0 467 053 B1 | 1/1992 | European Pat. Off. . |
| WO 94/03237 | 2/1994 | WIPO . |

OTHER PUBLICATIONS

D.P. DuFaux et al., "Nanoscale Unagglomerated Nonoxide Particles from a Sodium Coflow Flame," *Combustion and Flame*, 100 (1995), pp. 350–358.

R.J. Santoro et al., "Soot Formation in Diffusion Flames: Flow Rate, Fuel Species and Temperature Effects," Twentieth Symposium (International) on Combustion/The Combustion Institute, 1984, pp. 977–1006.

J. Burdeniuc et al., "Mineralization of Chlorofluorocarbons and Aromatization of Saturated Fluorocarbons by a Convenient Thermal Process," *Science*, Vo. 271, Jan. 19, 1996, pp. 340–341.

I. Glassman et al., "A Gas–Phase Combustion Synthesis Process for Non–Oxide Ceramics," Twenty–Fourth Symposium (International) on Combustion/The Combustion Institute, 1992, pp. 1877–1882, 1869–1876.

H.F. Calcote et al., "A New Gas–Phase Combustion Synthesis Process for Pure Metals, Alloys, and Ceramics," Twenty–Fourth Symposium (International) on Combustion/The Combustion Institute, 1992, pp. 1869–1876.

Akira Oku et al., "Complete Destruction of Chlorofluorocarbons by Reductive Dehalogenation Using Sodium Naphthalenide," Ind. Eng. Chem. Res., No. 28, 1989, pp. 1055–1059.

M.R. Zazahariah et al., "Application of Ab Initio Molecular Orbital and Reaction Rate Theories to Nucleation Kinetics," *Aerosol Science and Technology*, No. 19, 1993, pp. 499–513.

R.A. Dobbins et al., "Morphology of Flame–Generated Soot As Determined by Thermophoretic Sampling," *Lanqmuir*, vol. 3, No. 2, 1987, pp. 254–259.

M.R. Zachariah et al., "Simulation of Ceramic Particle Formation: Comparison with in–situ Measurements," *AIChE Journal*, Dec. 1989, vol. 35, No. 12, pp. 2003–2012.

K.L. Steffens et al., "Optical and Modeling Studies of Sodium/Halide Reactions for the Formation of Titanium and Boron Nanoparticles," *Chemistry of Materials*, vol. 8, No. 8, pp. 1871–1880.

R. Dagani, "CFC–Destroying Reaction, Convenient method uses sodium oxalate," *Chemical & Engineering News*, vol. 74, No. 4, Jan. 22, 1996, pp. 6–7.

*Primary Examiner*—Gary P. Straub

*Attorney, Agent, or Firm*—Evenson, McKeown, Edwards & Lenahan

[57] ABSTRACT

A method of destroying halogenated compounds by a vapor phase chemical reaction using an alkali metal vapor, alkaline earth metal vapor, or a combination of the two, in a heated reactor to produce mineralized or solid products. The production of solid products, such as halide salts and particulate carbon, yields numerous advantages in the collection and disposal of the resulting products. The invention is especially useful for the destruction of chlorofluorocarbons.

22 Claims, 4 Drawing Sheets

PROCESS FOR DESTROYING HALOGENATED COMPOUNDS

BACKGROUND OF THE INVENTION

1. Field of the Invention

The invention relates to the chemistry of halogenated compounds.

2. Description of Related Art

As chemical products are replaced, become outdated, or are banned for certain uses, stockpiles of potentially hazardous or environmentally harmful chemicals may accumulate. Even the storage of such materials may become potentially hazardous if storage methods are compromised. Ideally, such chemical waste should be broken down or degraded into harmless compounds. However, known degradation process are often expensive and/or may produce hazardous by-products.

Halogenated compounds constitute a growing percentage of such chemical waste. For example, halocarbons present particular problems since the by-products released during their destruction are often dangerous halogens.

One type of halocarbon, chlorofluorocarbons (CFCs), represents one group of chemicals that is becoming outdated. Since Dec. 31, 1995, manufacture of CFCs has been banned. Prior to that, market demand for reclaimed/recycled CFCs had already dropped significantly (see Heating, Piping, and Air Conditioning, 65 (4), p. 39, 1993). The result is an existing stockpile of CFCs that cannot be used. The stockpile may cause serious damage to stratospheric ozone if allowed to escape into the atmosphere.

As an alternative to destruction, some CFCs can be used as intermediates in the production of hydrochlorofluorocarbons (HCFCs). However, the HCFCs are also scheduled for a manufacturing ban in the year 2030. Destruction, then, may be the best and most desirable approach for CFC suppliers to eliminate existing stockpiles of CFCs, and there is a need for efficient methods to destroy such stockpiles.

Commonly used methods for destroying halocarbon compounds employ incineration. Although theoretical destruction efficiencies exceeding 99.9% may be achieved through conventional incineration, there are some practical difficulties in maintaining the necessary time and temperature to destroy many of the more stable species. Furthermore, incineration produces by-products such as HF or HCl which are themselves toxic and must be removed. Products of incomplete combustion present an even bigger concern since the potential to produce substances such as polychlorinated dibenzo-p-dioxins and dibenzofurans exists [5, 7].

As noted, incineration alone can be used to destroy some percentage of the halocarbons. But reactants have also been used or added to incineration or destruction processes to attempt to make the destruction reaction more efficient. For example, the use of sodium-containing compounds or alkali metal-containing compounds has recently been discussed. (See, for example, European Patent Application No. EP 467 053; Chemical & Engineering News, vol. 74, no. 4, pp. 6–7 (1996); Science, vol. 271, pp. 340–341 (1996), and Ind. Eng. Chem. Res., vol. 28, pp. 1055–1059 (1989).)

Generally, reactants added to a destruction reaction chamber are in liquid or solid form. For example, metallic sodium in liquid or molten phase has been used. (U.S. Pat. Nos. 4,465,590 and 5,545,390 and PCT application no. WO 94/03237.) The dispersion by chemical reaction process, in U.S. Pat. No. 5,108,647, also discusses combinations of liquid and solid phase reactants.

Fitzpatrick et al., U.S. Pat. No. 4,029,484, discusses using a mist of liquid droplets of aqueous acid or an aqueous acid salt in processes for removing waste halides. The waste halides considered in the document do not, however, encompass halocarbons.

Lalancette et al., U.S. Pat. No. 4,631,183, discusses a process for destroying halogenated organic compounds involving addition of solid carbonate or bicarbonate of an alkali metal or alkaline earth metal under reductive reaction conditions at temperatures of at least 1000° C., i.e. from 1000° C. to 1600° C. (see Col. 3, lines 32–33), whereby alkali or alkaline earth metal vapors apparently are produced "in situ". This process also produces toxic gaseous components that must be further handled or treated (see Col. 2, lines 39–42).

Other uses of sodium have been discussed. PCT Application no. WO 94/0327, describes a process involving passing CFC vapors through a bath of molten sodium. Reaction products are formed in the bath and must be separated from the molten sodium. Another method involves passing CFCs through powdered sodium oxalate, producing sodium chloride, sodium fluoride, and carbon dioxide [3]. This process has the advantage of bypassing the effects inherent in the incineration or plasma methods, but the process is expensive in both material and time. (See also Science, 271, p. 340) For example, sodium oxalate is quite expensive, as discussed in Chem. & Eng. News Vol. 74, No. 4. Additionally, the sodium oxalate process produces carbon dioxide, a greenhouse gas.

There are other, currently used processes for the destruction of CFCs, including those discussed in Refs. 1–6. For example, solid supports or matrices have been used to hold the sodium-containing compounds through which the halocarbons are passed. In addition, electronic processing methods have brought plasma destruction to the industry's attention. However, plasma destruction also results in volatile products, and high destruction efficiencies have not been proven [6].

Despite the efforts of the prior art, there remains a need for an efficient and cost-effective process for destroying halocarbons, particularly one which lends itself to use of a streamlined, continuous feed reactor.

SUMMARY OF THE INVENTION

An object of this invention is to fulfill the needs in the art for better methods to destroy halogenated compounds. In accordance with that object, in one aspect, the invention utilizes a gas phase reaction to efficiently destroy halogenated compounds. Numerous advantages attach to the use of this reaction in methods to destroy halogenated compounds, including: high destruction efficiencies (99+%); low residence times (milliseconds), which significantly lowers energy costs; in many instances, the reaction products are mineralized or in solid form and, thus, are easily removed by particulate collection devices; and the reaction products can be in a form usable by other industries.

By providing these advantages, the invention advances the state of the art of halogenated compound destruction technology. Further advantages and benefits of the invention will be apparent from the following and from the practice of the invention. The invention is particularly useful for destroying environmentally harmful CFCs. Other halogenated compounds may also be destroyed, such as chemical warfare agents.

A further object of the invention is to provide the conditions for a mineralization reaction of a halocarbon in a method or apparatus. For example and under appropriately designed conditions according to this invention, a halocarbon and an alkali metal vapor mix and a reaction occurs forming products comprising alkali metal-halide salt and elemental carbon.

Yet another object of the invention is to provide a method for destroying halogenated compounds amenable to a continuous-flow apparatus or a closed-loop apparatus. This description and the examples below show how successful the method of the invention is at achieving these and other objects.

These and other objects are achieved in accordance with one aspect of the present invention by providing a method for destroying halogenated compounds that comprises directly reacting a halogenated compound with vapor of at least one metal selected from the group consisting of alkali metals and alkaline earth metals in a heated reactor. When halocarbon compounds are used, the reaction forms products comprising solid halide salts and particulate carbon. However, the method is not limited to destroying halocarbons. Other halogenated compounds, for example HCl, HF, $Cl_2$, $F_2$, and $SF_6$, can be destroyed through the method of the invention. In these cases, solid alkali metal-halide salts can be produced. Some specific embodiments may include introducing a composition comprising a halocarbon into a reactor and injecting a selected amount of a composition comprising an alkali metal vapor and/or an alkaline earth metal vapor into the reactor. The amount selected depends on the extent of mineralization desired or depends on the factors discussed below. Mineralization refers to a process of forming solid final products from a gas phase reaction. The use of sodium vapor as the vapor composition is preferred. The reactor, containing at least one halocarbon and the introduced vapor (s), is heated to a selected temperature that causes the contents to form solid or mineral products in a gas phase reaction. The temperature selected depends on the halocarbons present and the vapor(s) used or depends on the factors discussed below. When sodium vapor is selected, for example, mineralized sodium halide salts and elemental carbon result, both of which can easily be removed from the reactor. The generation of solidified or mineralized products represents a distinct advantage over other destruction processes.

A number of modifications to this aspect of the invention exist. They include introducing an inert gas into the reaction chamber with the halocarbon or halogenated compound, employing a halocarbon compound or mixture that is substantially in the gas phase and mixed with another gas, and employing a temperature of heating in the range of approximately 1000 K. to approximately 2000 K. There are no specific temperature limits for the methods of the invention. However, the temperature should result in an alkali metal or alkaline earth metal vapor concentration equal to or greater than the amount of halogen present. More specific embodiments of this aspect of the invention involve using at least one halocarbon compound that is a chlorofluorocarbon, or using a vapor composition that comprises sodium vapor.

In specific embodiments of a method for destroying chlorofluorocarbons (CFCs), the method comprises mixing vapor-phase CFCs and alkali metal in a single-pass process and heating. In these specific embodiments, sodium vapor can be selected and used and temperatures at least about 1000 K. are selected, based on the use of a sodium metal vaporization temperature of 950 K. However, in accordance with the invention, other vapors or vapor compositions can be selected and used with other appropriately selected temperatures or ranges. If sodium is used as the vapor, the amount of sodium in the injected vapor composition can be selected by determining the amount of halide present in the halocarbon composition and selecting a substantially equivalent amount based on the stoichiometry of the reaction. This amount is sufficient to substantially completely mineralize the contents of the reactor. However, gaseous products may also be formed, such as $H_2$ with HCFC or other hydrogen-containing halocarbons. These specific embodiments lead to the mineralization of the carbon and halogen components, i.e., to reaction products that are in solid form. The method demonstrated high destruction efficiencies for the surrogate CFC tetrafluoromethane ($CF_4$) as well as high efficiency for the formation of the predicted products of the reaction (benign salt coated carbon aerosols, large enough to be filtered with existing filtering technologies).

In accordance with another aspect, the objects are achieved by providing a method for mineralizing compounds from a mixture of chemicals, where the mixture comprises at least one halogenated compound-containing compound. This method involves adding the mixture to a reactor, introducing a selected amount of a vapor composition that comprises an alkali metal vapor, an alkaline earth metal vapor, or a combination of alkali metal and alkaline earth metal vapors, and heating the reactor to a temperature at which the halocarbon reacts directly with the metal vapor to form products comprising a solid reaction product. Again, a number of modifications to this aspect of the invention exist, including using sodium vapor, adding a mixture of chemicals that comprises chlorofluorocarbon, and selecting a temperature of approximately 1000 K. to approximately 2000 K. As above, the amount of alkali metal and/or alkaline earth metal in the vapor composition in the reaction depends on the degree of mineralization desired. For substantially complete mineralization, the amount can be selected by determining the amount of halide present in the mixture of chemicals and selecting a substantially equivalent amount of alkali metal and/or alkaline earth metal based on the stoichiometry of the reaction. Amounts in excess of the stoichiometric amount may be desired to ensure substantially complete mineralization in certain apparatus for performing the method of the invention.

The rapid chemical reaction and condensation achieved through the method of the invention enables the construction of industrially useful apparatus that are fairly small and, therefore, economical to build and operate. Thus, in accordance with yet another aspect of the invention, the objects are achieved by providing a method to be used in an apparatus comprising a reactor, an injector for introducing a selected amount of a vapor composition operably connected to the reaction, and a reactor heating device. The injector is designed to introduce a vapor composition that comprises an alkali metal vapor, an alkaline earth metal vapor, or a combination of alkali metal and alkaline earth metal vapors.

In addition, embodiments of the method may be performed in an apparatus that comprises a flow-through burner, as shown in FIG. 2. Or, an apparatus can be a closed-loop system that may also comprise a particle separator capable of separating solid reaction products from a gas flow (FIG. 4). Various reactors, vapor or gas injection devices, monitors, flow-through designs, burners, and related devices may be selected from those available in the art.

In all aspects of the invention, appropriate concentrations and amounts of the alkali metal vapor, alkaline earth metal vapor, or mixture of vapors used can be selected for and/or maintained in the reactor as the vapor composition. Depending on the degree of solidification or mineralization of the reactor contents desired, ranging from substantially complete mineralization to a limited amount of mineralization, the selection of an appropriate amount of vapor composition, containing an amount of alkali metal and/or alkaline earth metal, can be determined by stoichiometric methods known in the art, as exemplified below. As discussed, amounts in excess of the stoichiometric amount may be desired for complete mineralization with certain embodiments. Likewise, the selected temperature or temperature range for the reaction depends on the vapor or vapors used in a destruction or mineralization method and can be determined by those skilled in the art, as exemplified below.

Various methods or apparatus for generating the vapor or vapor compositions used in this invention exist and are known in the art. The selection of a particular method or apparatus is not critical. When the preferred alkali metal vapor, sodium vapor, is used, the vapor may be created in a high temperature saturating device and carried to the reaction region with a carrier gas, such as an inert gas. In addition, the reaction environment can be a variety of different reactors or reaction chambers. The heating of the reactor can be accomplished in numerous ways known in the art and may include a variety of burners, which may exist as a part of the reactor system selected.

Commonly, halogenated compounds exist as highly volatile compounds. In accordance with this invention, the halogenated compounds may be fed directly to the reaction region or transported by a carrier gas. As a result, the method of the invention allows safer halocarbon handling conditions. Furthermore, the reaction products comprise condensed phase products or solids, in particulate form at normal operating conditions of 800° C. and atmospheric pressure. Therefore, the reaction described and method provided are also safer in that the reaction may occur in a closed system with no harmful gaseous emissions.

Beyond the advantages noted above, there are a number of other advantages to the method of the invention. For example, since the reaction products are solid, the method reduces or eliminates the need to treat and remove gaseous products, which can often be toxic or harmful. In addition, the method is generally more efficient and more cost effective than prior methods since the solid products can be easily removed from the reactor to facilitate repeated reactions in the same reactor. The invention can also advantageously utilize lower temperatures in the reaction chamber compared to the temperature required in other processes. In some specific embodiments, the benefits of a gas phase sodium reaction are nontoxic reaction products and resulting halogens that are contained in the sodium-halide salt product, which may be easily separated from the process gasses.

The following examples and specific descriptions encompass preferred embodiments utilizing sodium vapor as reactant. However, the invention is not limited to the use of sodium vapor. Other alkali metals, such as Li, K, and Cs can be used in place of Na, or combinations of alkali metal vapors can be used. In addition, the alkali metal may be replaced or combined with alkaline earth metal vapor(s), such as Be, Mg, Ca, Sr, or Ba. Thus, embodiments can be designed with a number of alkali metal and/or alkaline earth metal vapors or a composition of these vapors. As long as the metal can be vaporized and introduced into an appropriate reactor, the chemical reactions, conditions, and advantages described herein can be used to generate embodiments encompassed by this invention.

Other objects, advantages, and novel features of the invention will become apparent from the following detailed description of specific embodiments. One skilled in the art understands that both the foregoing general description and the following detailed description are exemplary and explanatory only and are not restrictive of the invention, as claimed. The spirit and scope of the invention are to be limited only by the terms of the appended claims.

DESCRIPTION OF SPECIFIC EMBODIMENTS OF THE INVENTION

Figure 1:
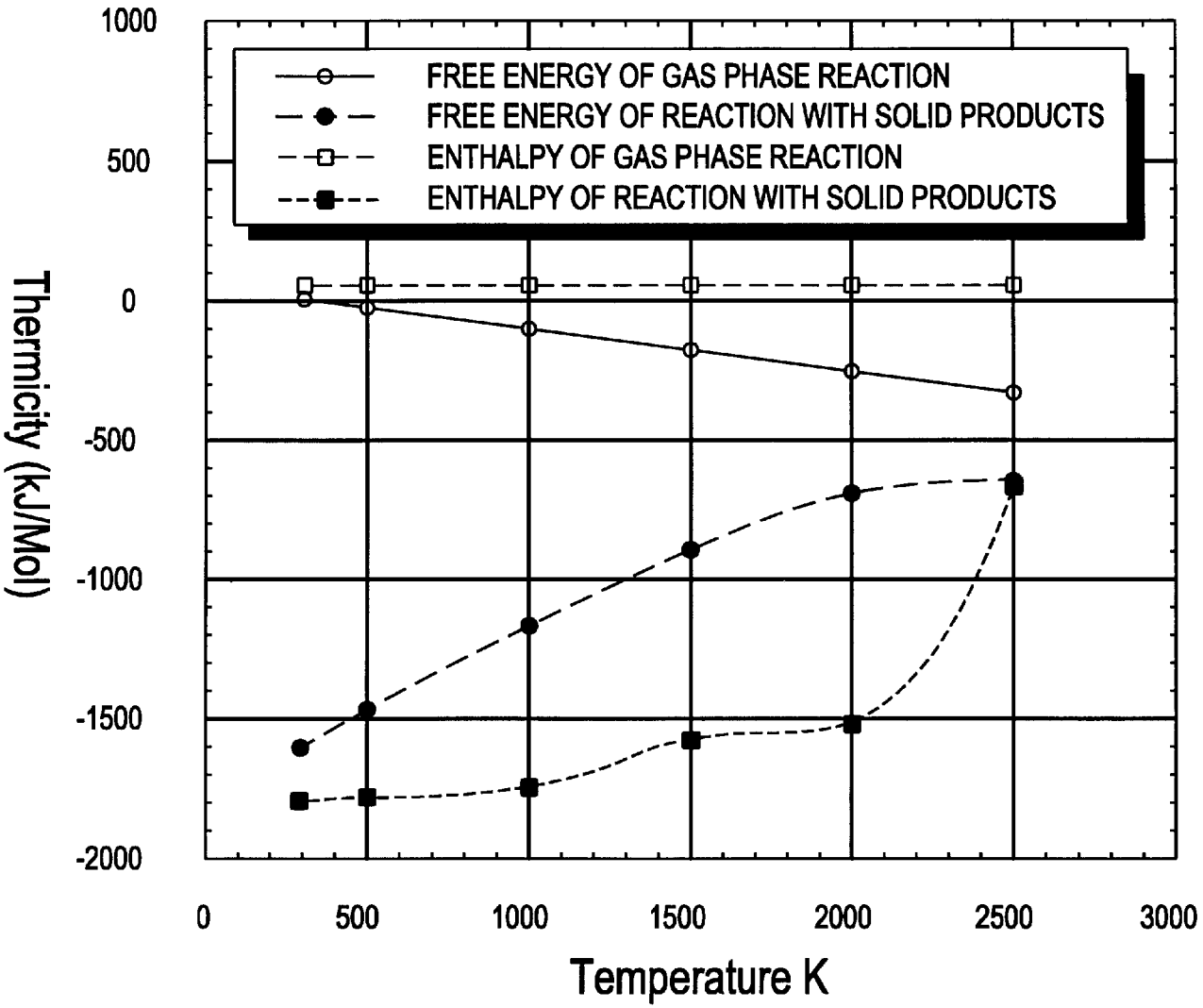
FIG. 1 is a graph of the free energies and enthalpies (exothermicity) vs. temperature of four separate reaction phase and product phase conditions for the reaction $Na+CF_4 \rightarrow C+NaF$.

The description below presents analytical considerations for optimizing any particular embodiment of the invention. While the representative compound $CF_4$ is exemplified, other halogenated compounds may be substituted. The detailed description of methods employing a halocarbon should not be taken as a limitation of the scope of this invention to any particular halogenated compound or any group of halogenated compounds, such as halocarbons. In addition, mixtures of halogenated compounds or halocarbons, or mixtures containing halogenated compounds or halocarbons, can also be used.

The invention provides a new and efficient method for destroying halogenated compounds. In one embodiment of the invention, CFCs are dehalogenated by reaction with sodium vapor, with subsequent nucleation/condensation into solid sodium-halide salt(s) and elemental carbon. This is illustrated by the following equation (1):

$$(y)Na+CX_y \rightarrow (y)NaX(s)+C(s) \quad (1)$$

where

X=F, Cl, Br and/or I;

$CX_y$ represents any selected halocarbon with a corresponding value for y based on that halocarbon; and (s) indicates solid phase. Another example is represented by equation (2):

$$Na+HCl \rightarrow NaCl(s)+\tfrac{1}{2}H_2 \quad (2)$$

where (s) indicates solid phase. The chemistry of the reaction is related to that presented by Calcote and Felder [8], Glassman et al. [9], DuFaux and Axelbaum [10] and Steffens et. al. [11] for the production of nanoscale materials, a different field of art. The process has high conversion efficiencies (99+%) arid the byproducts are benign aerosols, such as sodium chloride, sodium fluoride, and elemental carbon suspended in a gas. Furthermore, the carbon particulates may be of commercial importance because they contain zero hydrogen and because of their size and state of agglomeration. Thus, the reaction products of the invention may be recycled. Another industrial advantage is that the metallic sodium reactant is inexpensive, and scale-up of the method should present no problems preventing implementation.

Thermodynamic Evaluation for Optimizing Conditions

When substantially complete mineralization is desired, a generic reaction equation (3) for the mineralization of CFCs by sodium vapor reduction may be written as:

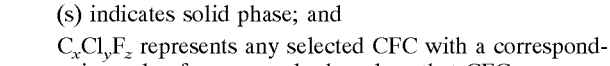

$$C_xCl_yF_z(v)+(y+z)Na(v)\rightarrow xC(s)+yNaCl(s)+zNaF(s) \quad (3)$$

where (v) indicates vapor phase;

(s) indicates solid phase; and $C_xCl_yF_z$ represents any selected CFC with a corresponding value for x, y, and z based on that CFC.

A specific reaction (4) for the exemplified CFC (tetrafluoromethane, $CF_4$) is:

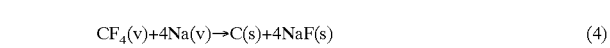

$$CF_4(v)+4Na(v)\rightarrow C(s)+4NaF(s) \quad (4)$$

These and similar equations can be used to determine the amount of Na introduced into the reaction. Excess Na can be introduced to ensure substantially complete reactions. Decreasing the amount of Na used can result in less than complete mineralization of the reactants. Of course, Na can be substituted by another alkali metal and/or by an alkaline earth metal.

Thermodynamics can be used to provide information on the conditions for efficient mineralization of the CFCs. Thermochemical computations were conducted using thermodynamic data from the JANAF tables [13] and the NASA thermodynamic equilibrium code [12], as known in the art.

The overall reaction to gas phase products is slightly endothermic and, since the elementary steps in the reaction will be gas phase, the gas phase chemistry will be the energetically limiting steps.

The exact elementary steps of the gas phase reaction for the destruction of $CF_4$ are not known and need not be known for purposes of this invention. However, the steps may involve the following process:

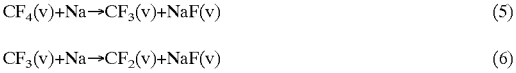

$$CF_4(v)+Na\rightarrow CF_3(v)+NaF(v) \quad (5)$$

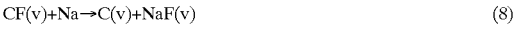

$$CF_3(v)+Na\rightarrow CF_2(v)+NaF(v) \quad (6)$$

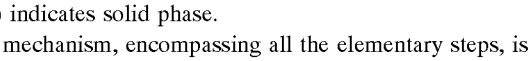

$$CF_2(v)+Na\rightarrow CF(v)+NaF(v) \quad (7)$$

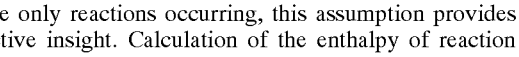

$$CF(v)+Na\rightarrow C(v)+NaF(v) \quad (8)$$

where (v) indicates gas or vapor phase, and (s) indicates solid phase.

This mechanism, encompassing all the elementary steps, is written assuming the chemistry is primarily a sequential stripping of a halide atom by sodium [11]. While certainly not the only reactions occurring, this assumption provides predictive insight. Calculation of the enthalpy of reaction shows that at 1500 K., reactions 5, 7, and 8 are in fact endothermic by approximately 63, 41, and 68 kJ respectively and would require some thermal activation. The results are summarized in Table 1.

TABLE 1

| Gas Phase Reaction | 298 K | 500 K | 1000 K | 1500 K | 2000 K | 2500 K |
|---|---|---|---|---|---|---|
| | Free Energy of Reaction (kJ) / Enthalpy of Reaction (kJ) | | | | | |
| $CF_4 + Na \rightarrow CF_3 + NaF$ | 45.1 | 31.3 | −1.9 | −33.7 | −64.5 | −94.4 |
| | 65.9 | 66.1 | 64.8 | 62.5 | 59.9 | 57.1 |
| $CF_3 + Na \rightarrow CF_2 + NaF$ | −121.3 | −129.4 | −148.8 | −166.9 | −184.1 | −200.5 |
| | −109.1 | −108.9 | −109.9 | −112.1 | −114.7 | −117.3 |
| $CF_2 + Na \rightarrow CF + NaF$ | 28.7 | 21.2 | 2.4 | −16.2 | −34.4 | −52.3 |
| | 39.9 | 40.6 | 41.1 | 40.7 | 40.2 | 39.7 |
| $CF + Na \rightarrow C + NaF$ | 61.1 | 58.9 | 52.7 | 45.8 | 38.7 | 31.5 |
| | 64.9 | 65.8 | 67.4 | 68.5 | 69.4 | 70.3 |

The reaction shown in equation (4) was chosen as the specific case to be investigated because of the high thermodynamic stability of $CF_4$, relative to all other CFC's, making it the most difficult to mineralize. Since the method of the invention worked successfully for $CF_4$, any CFC can be treated similarly. The inert gas or carrier gas used for the computations is Argon (Ar), but others may be selected. It should be noted that molecular nitrogen added to the reaction could potentially lead to sodium cyanide. Substantially nitrogen-free conditions may be desirable.

The overall heat of reaction is highly exothermic for reaction (4). At 1000 K., for example, the heat of reaction is 1750 kJ/mol, which at 1 atmosphere and no inert gas, gives an adiabatic temperature of 3350 K. The exothermicity comes about, however, when the products are condensed. This is clearly illustrated in FIG. 1, which shows the free energies and enthalpies for the global reaction of $CF_4$. In FIG. 1, the free energy of the gas phase reaction is indicated by the open circles; free energy of the reaction resulting in solid or mineralized products is shown with the filled circles; the enthalpy of the gas phase reaction is identified by the open boxes, and the enthalpy of the reaction resulting in solid or mineralized products is shown with the filled boxes.

Assuming that the activation energy for the elementary steps is approximately equal to the endothermicity (the endothermicity is a minimum energetic barrier) and pre-exponential factors for the Arrhenius expression (A factors) of about $10^{14}$, which is reasonable for this class of abstraction reaction [11], characteristic reaction times can be estimated as a function of temperature and concentration. For example, at 1500 K. and 90% argon dilution, the $CF_4$ half life is on the order of $10^{-5}$ seconds for stoichiometric amounts of Na and $CF_4$. The subsequent reactions should be at least as fast based on heat of reaction considerations. At any but very high temperatures, gas phase carbon will be highly supersaturated and nucleation/condensation will proceed on the order of a few microseconds [14,15]. This nucleation process also serves as a product sink for the gas phase and implies that the elementary reaction steps will be essentially irreversible, even though they are endothermic. These rates suggest that residence times on the order of 10's of milliseconds should be sufficient for the mineralization process. Such short residence times for the reactions in the method of the invention represent a distinct advantage over other processes in the art.

Results obtained from the equilibrium calculations show that high conversion efficiencies can be achieved under a broad temperature range. Using the operating conditions of 5 mole percent tetrafluoromethane, 22 mole percent sodium and the balance argon, conversion efficiency remains in excess of 99.999% up to a temperature of 2000 K. (efficiency is defined as the percentage of CFC-bound halide converted to sodium halide). It should be noted that 22 mole percent sodium is in excess of the stoichiometric value by 10% (20 mole percent is stoichiometric). This value is explained in the section below. High conversion efficiencies at low temperatures offer the advantage of lower energy and reactor material costs and can be obtained by the addition of inert gas.

Stoichiometry: Selecting and Maintaining an Optimum Sodium Concentration

In designing particular embodiments of the invention, various concentrations or stoichiometric amounts of reactants may be selected. In a particular example, when $CF_4$ and sodium vapor are used and where substantially complete mineralization is desired, the optimum reaction stoichiometry was determined. The same principles used can be applied to any particular embodiment of the invention desired. As above, the amounts of Na (alkali metal and/or alkaline earth metal) can be modified or lowered.

In the example of $CF_4$ with carrier gas Ar and Na as alkali metal, equilibrium calculations for one atmosphere, 70% argon, and 2000 K., show that the conversion efficiency drops from over 99.999% with 10% excess sodium, to slightly over 99.9% at the stoichiometric value, to under 90% at a 10% sodium deficiency. Thus, if complete mineralization is desired, the reaction may be conducted under excess Na conditions, thereby better ensuring the complete mineralization. Practically, this does not present a problem because the products of reaction are solid phase, and the sodium may be condensed downstream of the solid removal and reused. Indeed, industrial implementation of the chemistry could be in a fully closed-loop configuration, where the particles are removed from the gas phase (by cyclone, electrostatic precipitation, or other particle separators, see FIG. 4), the remaining unreacted sodium is condensed out, and recycled along with the carrier gas (Ar).

Figure 4:
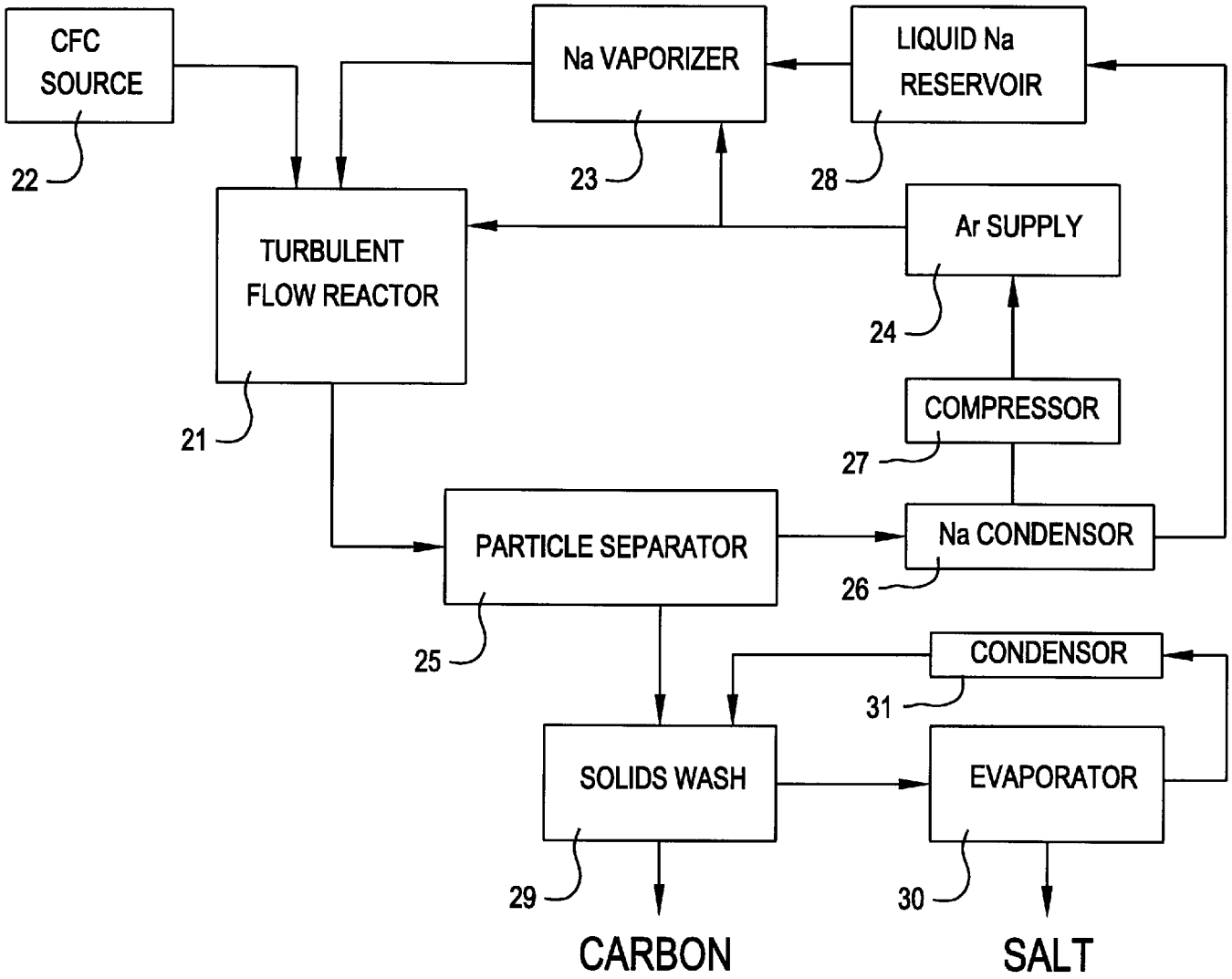
FIG. 4 is a schematic representation of a closed-loop apparatus for carrying out the method of the invention.

FIG. 4 shows a closed-loop apparatus for carrying out the method of the invention. The Turbulent Flow Reactor 21 is supplied by a source of CFC 22, a Na vapor source 23, and an inert gas source 24. Under the conditions for mineralizing the CFC, the turbulent flow reactor produces solid reaction products. Those products can be collected from a gas flow from the reactor by a particle separator device 25. Na can be recycled and re-used in the reactor by the Na condenser device 26 attached to a line feeding to a compressor 27 and the inert gas source 24 and the Na vapor source 23 or a line feeding a liquid Na reservoir 28 connected to the Na vapor source 23. The flow of mineralized particles collected in the particle separator device 25 can be further attached to a washing device 29. The washing device then allows output carbon and/or further processing in an evaporator 30 connected to a condenser 31 and the washing device 29. Output salts are discharged from the evaporator 30.

The elements of the closed-loop system of FIG. 4 can also be combined with other elements. For example, concentrations of gases can be monitored by monitoring devices, and the monitoring devices can be operably connected to the gas source to control its flow. Specifically, the flow of Na from the Na vapor source 23 and Na condenser 26, compressor 27, inert gas source 24 line can be monitored and controlled so that selected concentrations of Na are maintained in the system and in the reactor. Various monitoring and gas control systems are known in the art and can be used or adapted for use with the method of the invention.

EXAMPLES

To demonstrate the method of the invention, tetrafluoromethane (R-14) was injected into a sodium reactor. As mentioned, $CF_4$ was chosen as the model compound because it should be the most difficult to destroy.

Figure 2A:
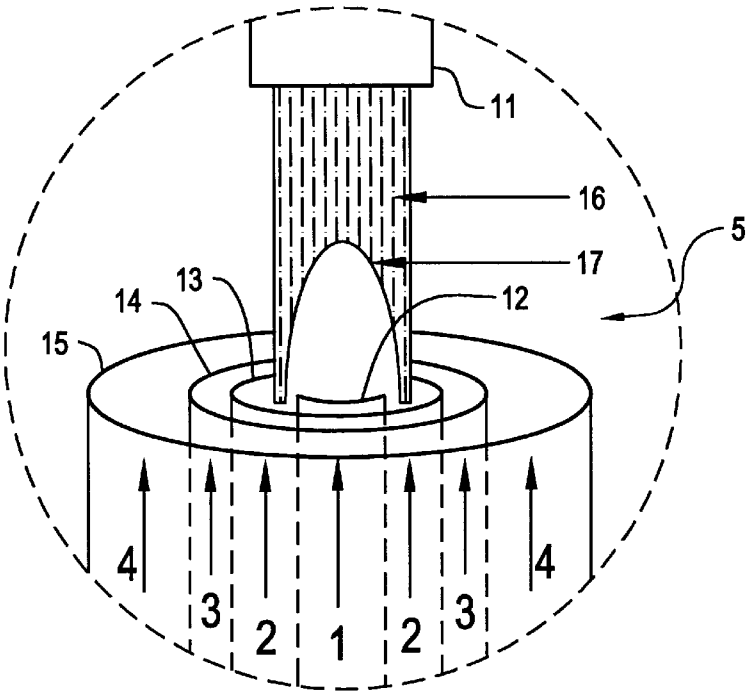
FIG. 2*a* is an enlarged detail view of the reactor thereof.
Figure 2:
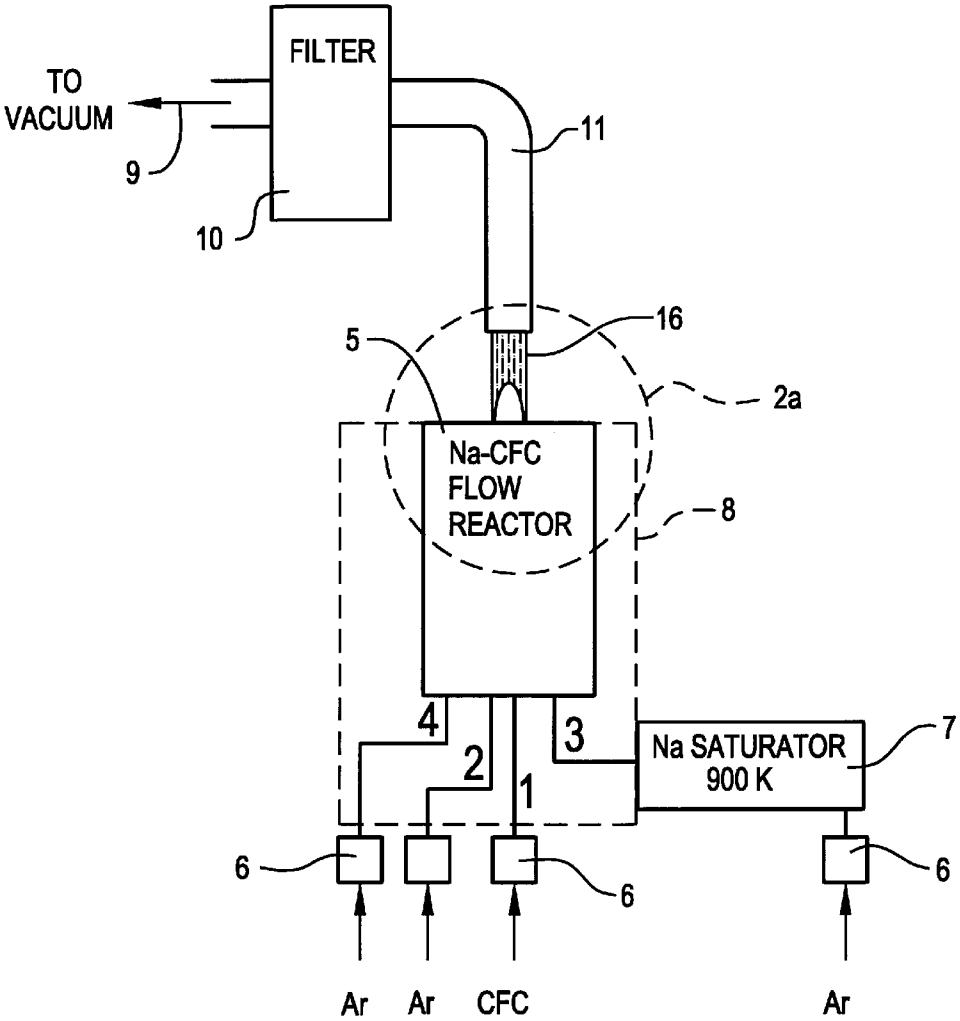
FIG. 2 is a schematic representation of a flow-through apparatus for carrying out the method of the invention.

An apparatus for carrying out the method of the invention, shown in FIG. 2, is based on the co-flow diffusion flame and can be similar in design to that used by DuFaux and Axelbaum [10]. Generally, separate two or more streams of reactants, such as CFC and inert gas (Ar) and inert gas inert gas (Ar) mixed with Na vapor, are injected into the burner 5 at a selected temperature so that they flow through the burner. Mineralized reaction products and gases discharged from the burner are drawn by a vacuum source 9 through a collection tube or discharge line 11 to a filter device 10, where solid particles can be collected.

In a preferred embodiment, the method of the invention may be carried out in an apparatus constructed of type 316 stainless steel, unless otherwise noted. The burner 5 is composed of four concentric tubes 12, 13 14 and 15, creating annular passageways for gas streams 1 through 4, which can be seen clearly in FIG. 2*a*, which is a close-up view of the burner. The inner tube 12 was machined from solid graphite round stock with an internal diameter bored to 3.2 mm and the outside of the injector varies from 5.0 mm to 12.5 mm. The variation in the outside diameter ensures flow uniformity and minimizes recirculation at the reactor exit. The next three tubes 13, 14 and 15 are stainless steel and have inner diameter/outer diameter dimensions of 12.6/15.9, 25.4/31.8 and 95.3/101.6 mm, respectively. Outermost tube 15 can be extended above the reactor exit to reduce radiation heat loss from the reactor exit. In this example, tube 15 was extended 100 mm and heated to 1100 K. To reduce recirculation at the reactor exit, the tubes are tapered near the burner. And to ensure flow uniformity, honeycomb flow straighteners (not shown) are located in both the second and third annular regions.

Innermost tube 12 was a graphite injector and supplied a stream of halocarbon or a halocarbon/carrier gas mixture 1 (in this case, tetrafluoromethane). The first annulus, created between the graphite injector 12 and the first annular tube 13, contains a flow of inert gas 2. This inert gas flow 2 is a practical requirement in this example due to formation of solid products that build up on injectors. Inert gas flow 2 separates the two reactants, thereby preventing build-up and potential clogging of reactor 5. The second annulus formed between tubes 13 and 14, supplies a flow of sodium vapor or sodium vapor/carrier gas mixture 3, and the outermost annulus, which is formed between tubes 14 and 15, supplies an inert flow 4, isolating the reactions from the atmosphere. In the apparatus of FIG. 2, the tetrafluoromethane and argon flow rates were controlled by calibrated mass flow controllers 6.

Sodium vapor is produced by passing preheated argon through a high temperature sodium saturation device 7 operated at temperatures up to 950 K. The sodium vapor concentration can be varied by adjusting the operating temperature of the saturation device or by adding diluent argon.

All lines from the saturation device to the reactor are maintained at an elevated temperature of 1000 K. to ensure that sodium remains in the vapor phase. In the Figure, the high temperature area 8 is indicated by a box drawn in broken lines. The reactor 5 is operated at 1100 K. so that radiative heat loss at the reactor exit does not reduce the temperature such that sodium condensation would occur.

The reactant gases exit the burner with a uniform temperature of 1000 K. The inner and outer flows of argon were preheated before entering the burner. All temperatures were measured with type k thermocouples and maintained at operating temperature by devices known in the art, such as with a commercially available heat controller or those reactors employing proportional integral differential (PID) controlled heaters.

The aerosol plume 16 which emanated from burner 5 was a well-defined stream of particles, which were collected by collection tube 11, which was formed from a 2.5 cm diameter stainless steel flexible tube positioned over the center of the burner, approximately 8 cm above the burner exit. This spacing corresponded to a flow time of less than 1 second. Suction from vacuum device 9 can be adjusted such that the stream of particles 16 is drawn into the collection tube 11 and thence passes to filter 10, which was a 10 micron porous-stainless-steel filter, where they were collected. Collected powders were analyzed using the following techniques: 1) measurement of fluorine ion concentration in water solutions with a fluorine ion selective electrode (FISE); 2) X-ray diffraction (XRD); and 3) elemental analysis on sodium and fluorine.

For the FISE technique, powder collected over a specified amount of time was mixed with a known amount of water, producing a solution well in excess of saturation (if all CFC was destroyed). Because the pH is very high due to the excess sodium collected during the experiment (which produces NaOH), the pH was adjusted by adding buffer solution to the specifications of the probe manufacturer. The probe was calibrated using three standard solutions: fluorine ion concentrations of 100, 500 and 1000 ppm. From the fluorine ion concentration measurements, the amount of NaF produced (assuming that C—F bonds would not dissociate in water) was determined and compared to the theoretical value of complete reduction.

Photographs of a reaction zone for a $CF_3Cl$—Na system look very similar to the well studied laminar diffusion flame [16]. The chemistry is similar to that summarized in Table 2, except that a much higher argon flow is mixed with the halide, providing a high velocity jet through the inner injector. This jet produces well defined lines that can be seen in a photograph. Photographs of the reaction zone also exhibit a bluish color surrounding the flame 17, which is caused by the strong absorption at the sodium D-lines (589 nm). Condensed sodium can be seen at the reactor exit. This low temperature region (reactor exit) is due to radiation heat loss to the surrounding environment. Under normal operation, the burner is surrounded by a heated shroud reducing radiation loss and thereby maintaining the burner exit at sufficient temperatures to avoid condensation.

Figure 3:
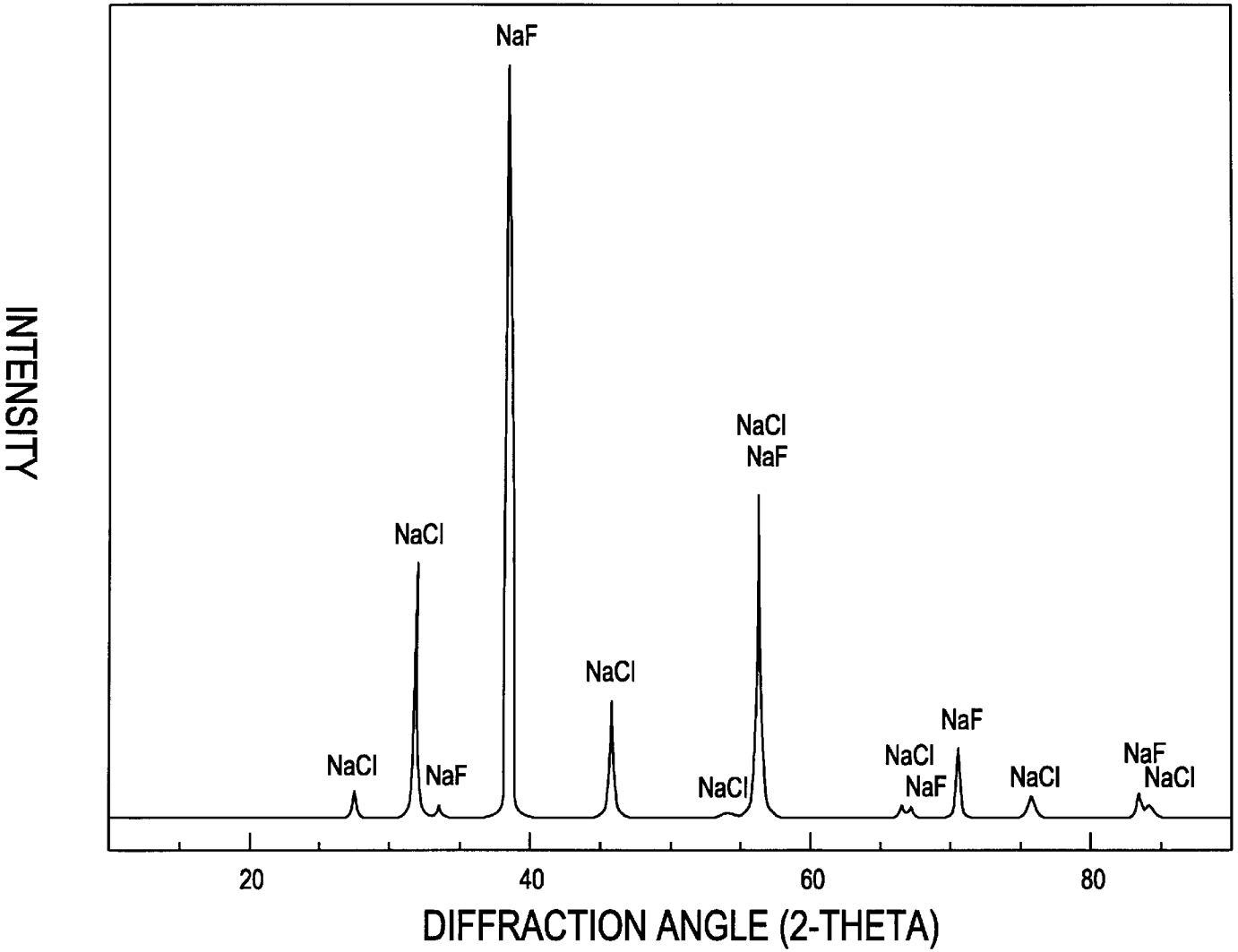
FIG. 3 is an X-ray diffraction pattern of products of a reaction according to the invention, with a graph of the diffraction angle vs. intensity of the X-rays detected shown.

An X-ray diffraction (XRD) spectrum of powder collected from a $CF_3Cl$/Na reaction is shown in FIG. 3. Each of the peaks in FIG. 3 is labeled with the corresponding compound (NaCl, NaF, NaCl/NaF). Powder from a $CF_4$/Na reaction produces a similar spectrum minus the NaCl peaks. Carbon does not appear in the spectrum due to its amorphus nature. To determine if fluorine was present in the carbon matrix, either as trapped NaF or bound fluorine for the examples with low conversion of $CF_4$, elemental analysis was performed. Example #6 of Table 2 was run under conditions such that sufficient sodium was available to completely reduce the tetrafluoromethane. The collected powder was twice washed with water and centrifuged. This washed powder was sent to a commercial laboratory for sodium and fluorine analysis. The results show 0.28 percent fluorine and 1.94 percent sodium, on a mass basis. The low value for fluorine indicates that the solid carbon component does not have any bound fluorine and that incomplete conversion of $CF_4$ presumably results in a gas-phase species or very small cluster that passed through the particle filtration system. The higher concentration of sodium may be the result of the formation of sodium peroxide, which has low cold-water solubility, residual sodium hydroxide from the wash, or direct sodium contamination of the carbon particles.

A transmission electron micrograph (TEM) of the particles produced in example 2 of Table 2 was obtained. Material was collected by inserting a carbon coated TEM grid into the reaction zone for approximately 0.1 second and at a location corresponding to approximately 0.5 sec flow time. Particles deposited on the substrate through thermophoretic forces developed between the hot process stream and the cold grid [17]. The micrograph shows individual and agglomerated structures consisting of 200–500 nm particles encapsulated in a coating of salt.

Elemental analysis indicates the particles are composed of sodium, fluorine and carbon. The carbon component within the salt shell may be a single particle, or a matrix of carbon and salt, or other structure. Because of the sampling technique, the powder shown in TEM micrographs is expected to be smaller than the bulk powder because the bulk powder particles will spend a longer time at high temperatures, causing further agglomeration. From an industrial prospective, the particle sizes produced are amenable to separation from the gas phase by standard methods.

Table 2 shows process parameters and conversion efficiencies for several different reactor conditions for a Na/$CF_4$ system. Injection regions for the summarized flow rates are detailed in FIG. 2.

TABLE 2

Flow Rates - sccm
Number in parenthesis corresponds to gas flow in FIGS. 2 & 2a

| Example | $CF_4$ (1) | Ar (1) | Ar (2) | Ar (3) | Na (3) | Ar (4) | Conversion Efficiency |
|---|---|---|---|---|---|---|---|
| 1 | 12.6 | 40 | 150 | 2000 | 99.4 | 35000 | 0.972 |
| 2 | 12.6 | 40 | 150 | 2000 | 99.4 | 35000 | 0.968 |
| 3 | 6.1 | 15 | 164 | 2000 | 96.6 | 35000 | 1.007 |
| 4 | 3.1 | 18 | 164 | 2000 | 96.6 | 35000 | 0.996 |
| 5 | 9.4 | 12 | 164 | 2000 | 96.6 | 35000 | 0.968 |
| 6 | 6.1 | 15 | 164 | 2000 | 63.1 | 35000 | 0.862 |

Table 2 shows that high conversion efficiencies can be achieved. In the thermodynamic evaluation section above, it was noted that excess sodium is required to substantially completely mineralize the CFC. The sodium flow rates in Table 2 are well in excess of the amounts discussed in the above section. This is due to radial diffusion losses associated with the type of laminar flow reactor used, which cannot be accounted for in the equilibrium calculations previously presented for a well mixed system. For industrial application, flows would be turbulent rather than laminar and the enhanced mixing will minimize the amount of excess sodium required.

In these examples, temperature effects are not expected to influence the process because of the low reactant concentrations. The adiabatic reaction temperatures are all below 1550 K., and, as discussed previously, not high enough to influence the process. Also, due to radiation heat loss from the solid products to the surroundings, the actual reaction temperature will be lower.

It will be apparent to those skilled in the art that various modifications and variations can be made in the method of the invention and in constructing an apparatus for carrying out the method without departing from the scope or spirit of the invention. It is intended that the specification and examples be considered as exemplary only, with a true scope and spirit of the invention being indicated by the following claims.

REFERENCES

The contents of each of the following references are specifically incorporated herein by reference.

1. Title 40 Part 82 of the Code of Federal Regulations.
2. SEMATECH Topical Workshop Proceedings on the "Economic and Technical Issues in Optimizing Plasma Processing to Minimize Environment, Safety and Health Impacts" July, Austin, Tex.; Jul. 1–2, 1996.
3. Burdeniuc, J. and Crabtree, R. H., *Science,* 271, 340 (1996).
4. Oku, A., Kimura, K., and Sato, M., *Ind. Eng. Chem. Res.,* 28, 1055 (1989).
5. Hassel, G. R., Springsteen, B. R., Sceker, W. R., and lee, C. W., "Experimental Investigation of PIC Formation from Incineration of CFCs", Proceedings from the Twelfth Incineration Conference, Knoxville, Tenn. (1993).
6. Bonizzoni, G., Casati, G., Pitea, D., Sindoni, E. (Eds.), Conference Proceedings Vol. 37, "Plasma Technologies for Hazardous Waste Destruction" SLF, Bologna, (1993).
7. Tsang, W., Burgess, D. R., and Babushok, V., "The Incinerability of Highly Fluorinated organic Compounds", to appear in Combust. Sci. and Tech.
8. Calcote H. F., and Felder W., Twenty-Fourth Symposium (International) on Combustion, The Combustion Institute, Pittsburgh, pp. 1869–1876 (1992).
9. Glassman, I., David, K. A., and Brezinsky, K., Twenty-Fourth Symposium (International) on Combustion, The Combustion Institute, Pittsburgh, pp. 1869–1876 (1992).
10. DuFaux, D. P., and Axelbaum, R. L., *Comb. and Flame,* 100, 350 (1995).
11. Steffens, K. F., Zachariah, M. R., DuFaux, D. P., and Axelbaum, R. L., *Chem. Mater.* 8, 1871 (1996).
12. Gordon, S., and McBride, B. J., "Computer Program for Calculation of Complex Chemical Equilibrium Compositions, Rocket Performance, Incident and Reflected Shocks, and Chapman-Jouguet Detonations" NASA-SP-273 (NASA Lewis Research Center), (1976).
13. Chase, M. W., Jr., Davies, C. A., Downey, J. R., Jr., Frurip, D. J., McDonald, R. A., and Syverud, A. N., JANAF Thermochemical Tables (American Chemical Society and the American Institute of Physics for the National Bureau of Standards, Midland, Mich., ed. 3rd. (1986).
14. Zachariah, M. R., and Semerjian, H. G., AIChE, J., 35, 2003 (1989).
15. Zachariah, M. R., and Tsang, W., Aeros. Sci. Tech. 19, 499 (1993).
16. Santoro, R. J., and Semerjian, H. G., Twentieth Symposium (International) on Combustion 977, (1984)
17. Dobbins, R. A., and Megaridis, C. M., Langmuir 3:2:254 (1987).

What is claimed is:

1. A method for destroying a halogenated compound, comprising:

introducing the halogenated compound into a reactor;

injecting a vapor of at least one metal selected from the group consisting of alkali metals and alkaline earth metals into the reactor;

then heating the reactor; and reacting said halogenated compound and said vapor to form products comprising solid halide salts.

2. A method as claimed in claim 1, further comprising introducing an inert gas into the heated reactor.

3. A method as claimed in claim 1, wherein the heated reactor is heated to a temperature in the range of approximately 1000 K. to approximately 2000 K.

4. A method as claimed in claim 1, wherein the halogenated compound is a halocarbon.

5. A method as claimed in claim 4, wherein the halocarbon comprises a chlorofluorocarbon and the products formed further comprise particulate carbon.

6. A method as claimed in claim 1, wherein the halogenated compound is introduced into the reactor in the gas phase admixed with a carrier gas.

7. A method as claimed in claim 1, wherein the vapor comprises sodium vapor.

8. A method as claimed in claim 1, wherein the metal selected from the group consisting of alkali metals and alkaline earth metals is present in the heated reactor in a stoichiometric excess of the halide atoms present.

9. A method as claimed in claim 8, wherein the metal selected is sodium.

10. A method as claimed in claim 9, wherein the halogenated compound comprises a chlorofluorocarbon and the products formed further comprise particulate carbon.

11. The method according to claim 1, wherein said vapor comprises a metal selected from the group consisting of Li, K, Cs, Be, Mg, Ca, Sr, Ba, and combinations thereof.

12. The method according to claim 1, wherein said reacting has a conversion efficiency of greater than 99%.

13. The method according to claim 1, wherein said reacting is exothermic.

14. A method of mineralizing a halogenated compound-containing mixture, said method comprising:

introducing said mixture into a reactor;

injecting a vapor composition comprising an alkali metal vapor, an alkaline earth metal vapor, or a combination thereof into the reactor; and then heating the reactor to a temperature at which the halogenated compound reacts directly with the metal vapor to form products comprising a solid reaction product.

15. A method as claimed in claim 14, wherein the vapor composition comprises sodium vapor.

16. A method as claimed in claim 14, wherein the halogenated compound-containing mixture comprises at least one chlorofluorocarbon and the products formed comprise particulate carbon.

17. A method as claimed in claim 14, wherein the reactor is heated to a temperature in the range of approximately 1000 K. to approximately 2000 K.

18. A method as claimed in claim 14, further comprising introducing an inert gas into the reactor.

19. A method as claimed in claim 14, wherein the alkali metal, alkaline earth metal, or the combination of alkali metal and alkaline earth metal present is in a stoichiometric excess to the amount of halide atoms present.

20. A method as claimed in claim 19, wherein the vapor composition comprises sodium vapor.

21. A method as claimed in claim 20, wherein the halogenated compound-containing mixture comprises a chlorofluorocarbon, and the products formed comprise particulate carbon.

22. A method for destroying a halogenated compound, comprising:

introducing the halogenated compound in a reactor;

injecting a vapor of at least one metal selected from the group consisting of alkali metals and alkaline earth metals in the reactor then heating the reactor; and forming products consisting of at least one of solid halide salts, elemental carbon and hydrogen gas.

* * * * *